US007907871B2

(12) United States Patent
Sakagawa et al.

(10) Patent No.: US 7,907,871 B2
(45) Date of Patent: Mar. 15, 2011

(54) IMAGE FORMING APPARATUS

(75) Inventors: Yoshio Sakagawa, Hyogo (JP); Tetsumaru Fujita, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 532 days.

(21) Appl. No.: 11/954,342

(22) Filed: Dec. 12, 2007

(65) Prior Publication Data

US 2008/0273898 A1 Nov. 6, 2008

(30) Foreign Application Priority Data

Dec. 15, 2006 (JP) ..... 2006-338507

(51) Int. Cl.
*G03G 21/00* (2006.01)
*G03G 15/30* (2006.01)
*G03G 15/02* (2006.01)

(52) U.S. Cl. ..... 399/128; 399/129; 399/149; 399/175; 399/353

(58) Field of Classification Search ..... 399/50, 399/128, 149, 174–176, 350, 353
See application file for complete search history.

(56) References Cited

U.S. PATENT DOCUMENTS

| | | | | |
|---|---|---|---|---|
| 5,323,215 | A * | 6/1994 | Ohtaka et al. | 399/89 |
| 5,701,559 | A * | 12/1997 | Ootaka et al. | 399/149 |
| 5,966,563 | A * | 10/1999 | Kashihara et al. | 399/100 |
| 6,421,512 | B2 * | 7/2002 | Watanabe et al. | 399/149 |
| 6,603,941 | B2 * | 8/2003 | Watanabe et al. | 399/129 |
| 6,856,777 | B2 * | 2/2005 | Enomoto et al. | 399/128 |
| 6,944,416 | B2 * | 9/2005 | Watanabe | 399/129 |
| 6,952,546 | B2 * | 10/2005 | Yoshikawa | 399/129 |
| 2003/0049048 | A1 * | 3/2003 | Yoshikawa et al. | 399/129 |
| 2004/0136749 | A1 * | 7/2004 | Kinoshita et al. | 399/129 |
| 2005/0169668 | A1 * | 8/2005 | Koichi et al. | 399/149 |
| 2007/0065179 | A1 | 3/2007 | Fujita | |
| 2007/0122190 | A1 * | 5/2007 | Kitajima | 399/129 |
| 2007/0172259 | A1 | 7/2007 | Fujita | |
| 2007/0280735 | A1 * | 12/2007 | Nagatomo et al. | 399/175 |
| 2009/0041491 | A1 * | 2/2009 | Shono et al. | 399/55 |
| 2009/0067887 | A1 * | 3/2009 | Fujita et al. | 399/262 |

FOREIGN PATENT DOCUMENTS

| | | | |
|---|---|---|---|
| JP | 02003287964 A | * | 10/2003 |
| JP | 2003-316202 | | 11/2003 |

* cited by examiner

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

An image forming apparatus that is more capable of preventing the occurrence of image quality deterioration caused by defective charging of a photoreceptor than the conventional one. As a charging device, there is used a member which has: a conductive sheet that causes the surface thereof applied with a predetermined bias to abut against the surface of the photoreceptor after passing through a primary transfer nip obtained by abutment between the photoreceptor and an intermediate transfer belt and before entering a development step performed by a developing device; a conductive brush member that applies a predetermined bias to the surface of the photoreceptor obtained after passing through the position of abutment with the sheet and before entering the development step; and a charging roller that uniformly charges the surface of the photoreceptor after passing through the position of abutment with the brush and before entering the development step. Furthermore, at least during a predetermined first period, a bias having a polarity same as the uniformly charging polarity of the photoreceptor is applied to the conductive sheet and brush member.

18 Claims, 6 Drawing Sheets

FIG. 3

| EXPERIMENT NO. | PERIOD | SHEET BIAS [V] | SURFACE POTENTIAL OF PHOTORECEPTOR AFTER PASSING THROUGH SHEET [V] | BRUSH BIAS [V] | EVALUATION RESULT | | | |
|---|---|---|---|---|---|---|---|---|
| | | | | | INITIAL PRINT | | 5,000TH PAGE | |
| | | | | | MEMORY | STRIPE | MEMORY | STRIPE |
| 1 | FIRST PERIOD (AT THE TIME OF PRINTING) | -1000 | -800 | -500 | ○ | ○ | ○ | ○ |
| | SECOND PERIOD | 0 | -10 - 20 | -500 | | | | |
| 2 | FIRST PERIOD (AT THE TIME OF PRINTING) | -1000 | -800 | -500 | ○ | ○ | ○ | × |
| | SECOND PERIOD | -1000 | -800 | -500 | | | | |
| 3 | FIRST PERIOD (AT THE TIME OF PRINTING) | -300 | 0 | -500 | × | ○ | × | ○ |
| | SECOND PERIOD | -300 | -10 - 20 | -500 | | | | |

| | SHEET BIAS DURING SECOND PERIOD [V] | | | |
|---|---|---|---|---|
| | 0 | +300 | +500 | +800 |
| DEFECTIVE CHARGING | ○ | ○ | ○ | ○ |
| SCUMMING | ○ | ○ | ○ | × |

IMAGE FORMING APPARATUS

BACKGROUND OF THE INVENTION

1. Field of the Invention

The present invention relates to an image forming apparatus, such as a copying machine, a facsimile machine and a printer, and more particularly to an improvement of a charging device that charges the surface of a latent image carrier uniformly.

2. Description of the Related Art

Generally, an electrophotographic image forming apparatus creates an image by the following processes. Specifically, first, a latent image carrier, such as a photoreceptor, that is charged uniformly is subjected to exposure scanning and the like to form an electrostatic latent image thereon, and this electrostatic latent image is developed by a developing device. Next, a toner image obtained by development is transferred from the latent image carrier to a transfer sheet or other recording body directly or via an intermediate transfer body.

As the image forming apparatus having such a configuration, the one described in, for example, Japanese Unexamined Patent Publication No. 2003-316202 is known. In this image forming apparatus, a toner image that is formed on a rotating surface of a drum-like photoreceptor, i.e., a latent image carrier, is primarily transferred to an intermediate transfer belt at a primary transfer nip formed by abutment of the photoreceptor with the intermediate transfer belt. Then, the surface of the photoreceptor is charged uniformly by a charging device after the toner image passes through the primary transfer nip. A transfer residual toner adheres to the surface of the photoreceptor after the toner image passes through the primary transfer nip, and a so-called cleaner-less system is employed in which the transfer residual toner within the developing device is recovered after the surface of the photoreceptor is charged uniformly, without removing the transfer residual toner.

Various methods for realizing the cleaner-less system are known. The conventional image forming apparatus described in the abovementioned publication adopts the following method. Specifically, first, the transfer residual toner that remains on the surface of the photoreceptor after passing through the primary transfer nip is trapped by a first brush that abuts against the photoreceptor while applying a bias having a polarity opposite to the normal charging polarity of the toner. Then, the transfer residual toner is gradually charged to the polarity opposite to the normal charging polarity within the first brush, and thereafter the transfer residual toner is slowly shifted to the photoreceptor having a polarity same as the normal charging polarity of the toner. In this manner, the transfer residual toner is temporarily trapped within the first brush and thereafter shifted slowly to the receptor, whereby it is possible to avoid defective charging that occurs when performing uniform charging on the photoreceptor while keeping a large quantity of transfer residual toner adhered thereto. The transfer residual toner that is shifted to the photoreceptor is charged again to the normal charging polarity by a second brush that abuts against the photoreceptor while applying a bias having a polarity same as the normal charging polarity of the toner. Then, the transfer residual toner is caused to pass through an abutting portion between the photoreceptor and a charging roller charging the photoreceptor uniformly, thereafter shifted to a developing sleeve at a developing region where the photoreceptor faces the developing sleeve of the developing device, and then recovered in the developing device. According to the abovementioned publication, the cleaner-less system can be realized by the series of steps described above.

However, according to an experiment performed by the three inventors of the present invention, the transfer residual toner, which has been trapped within the first brush applying the bias having a polarity opposite to the normal charging polarity of the toner, could not be transferred to the photoreceptor properly, whereby a large quantity of transfer residual toner was accumulated in the first brush. Then, the large quantity of accumulated transfer residual toner was shifted from the first brush to the photoreceptor at irregular times, causing defective charging of the photoreceptor.

The reason that the large quantity of transfer residual toner was accumulated in the first brush is as follows. Specifically, the polarity of the transfer residual toner trapped within the first brush is the normal charging polarity. In order to charge this transfer residual toner to the opposite polarity within the first brush, it is necessary to inject charges or discharge electricity from the first brush into toner particles. Moreover, by performing charge injection or electric discharge, it is necessary to apply a large amount of charges to the toner particles so that the polarity of the transfer residual toner is reversed.

However, since a plurality of bristles configuring the first brush and the toner particles are not closely attached to one another so well within the brush, it is difficult to perform good charge injection so as to move a large amount of charges in a short amount of time. Furthermore, there are quite a few toner particles that cannot be subjected to charge injection itself due to poor adhesion with the bristles. Therefore, it is difficult to reverse the polarity of the transfer residual toner trapped within the first brush, by performing charge injection. In addition, if the first brush is applied with a bias of a value high enough that electricity is discharged from the bristles, it means that this electric discharge is caused mainly between the brush and the photoreceptor, thus the charges obtained from this electric discharge pass through the toner particles and move to the photoreceptor. Therefore, it is difficult to reverse the polarity of the transfer residual toner trapped within the first brush, by means of the electric discharge from the bristles.

For these reasons, the transfer residual toner could not be shifted properly from the first brush to the photoreceptor.

The above has described the problems of the image forming apparatus using a cleaner-less system, but even in the system for cleaning the transfer residual toner by using cleaning means, a large quantity of transfer residual toner that can not be removed completely by the cleaning means might be accumulated in the first brush.

SUMMARY OF THE INVENTION

The present invention was contrived in view of the above circumstances, and an object thereof is to provide an image forming apparatus that is more capable than the conventional one of preventing the occurrence of image quality deterioration caused by defective charging of the latent image carrier.

BRIEF DESCRIPTION OF THE DRAWINGS

The above and other objects, features and advantages of the present invention will become more apparent from the following detailed description taken with the accompanying drawings, in which:

FIG. 3 is a table showing the result of each experiment of the present embodiment;

DESCRIPTION OF THE PREFERRED EMBODIMENTS

Hereinafter, an embodiment of an electrophotographic color laser printer (simply referred to as "printer" hereinafter) is described as an image forming apparatus to which the present invention is applied.

First, the basic configuration of the printer according to the present embodiment is described.

Figure 1:
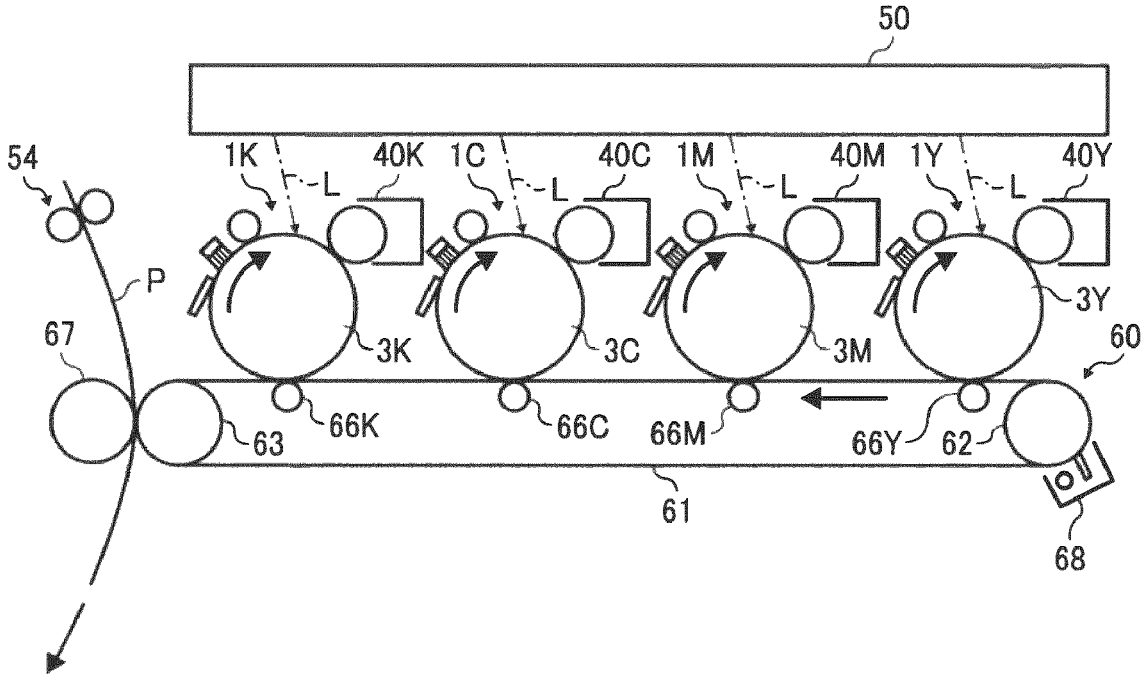
FIG. 1 is a view showing a schematic configuration of a printer according to an embodiment of the present invention.

FIG. 1 shows substantial parts of the printer according to the present embodiment. This printer has four process units 1Y, M, C and K that form yellow, magenta, cyan and black (denoted by Y, M, C and K hereinafter) toner images respectively. The printer also has an optical writing unit 50, a resist roller pair 54, a transfer unit 60 and the like. The letters Y, M, C and K that are added at the end of the reference numerals mean that these parts indicate the members for the colors yellow, magenta, cyan and black.

The optical writing unit 50, i.e., latent image forming means, has a light source composed of four laser diodes corresponding to the colors Y, M, C and K respectively, a polygon mirror composed of a regular hexahedron, a polygon motor that rotates and drives the polygon mirror, a fθ lens, a lens, a reflecting mirror, and the like. Laser beams L emitted from the laser diodes are reflected by any one of the surfaces of the polygon mirror, and reach any of four photoreceptors described hereinafter, while being deflected as the polygon mirror rotates. The laser beams L emitted from the four laser diodes optically scan the surfaces of the four photoreceptors Y, M, C and K, respectively.

The process units 1Y, M, C and K have, respectively, drum like photoreceptors 3Y, M, C and K as latent image carriers, and developing devices 40Y, M, C and K corresponding individually to these photoreceptors. Each of the photoreceptors 3Y, M, C and K is obtained by coating an aluminum pipe stock with an organic photosensitive layer, and is rotated and driven by driving means, not shown, in the clockwise direction in the drawing at a predetermined linear velocity. Then, each of the photoreceptors is subjected to optical scanning in the dark by the optical writing unit 50 emitting the laser beams L that are modified based on image information sent from an unshown personal computer or the like, whereby Y, M, C and K electrostatic latent images are carried by the respective photoreceptors.

Figure 2:
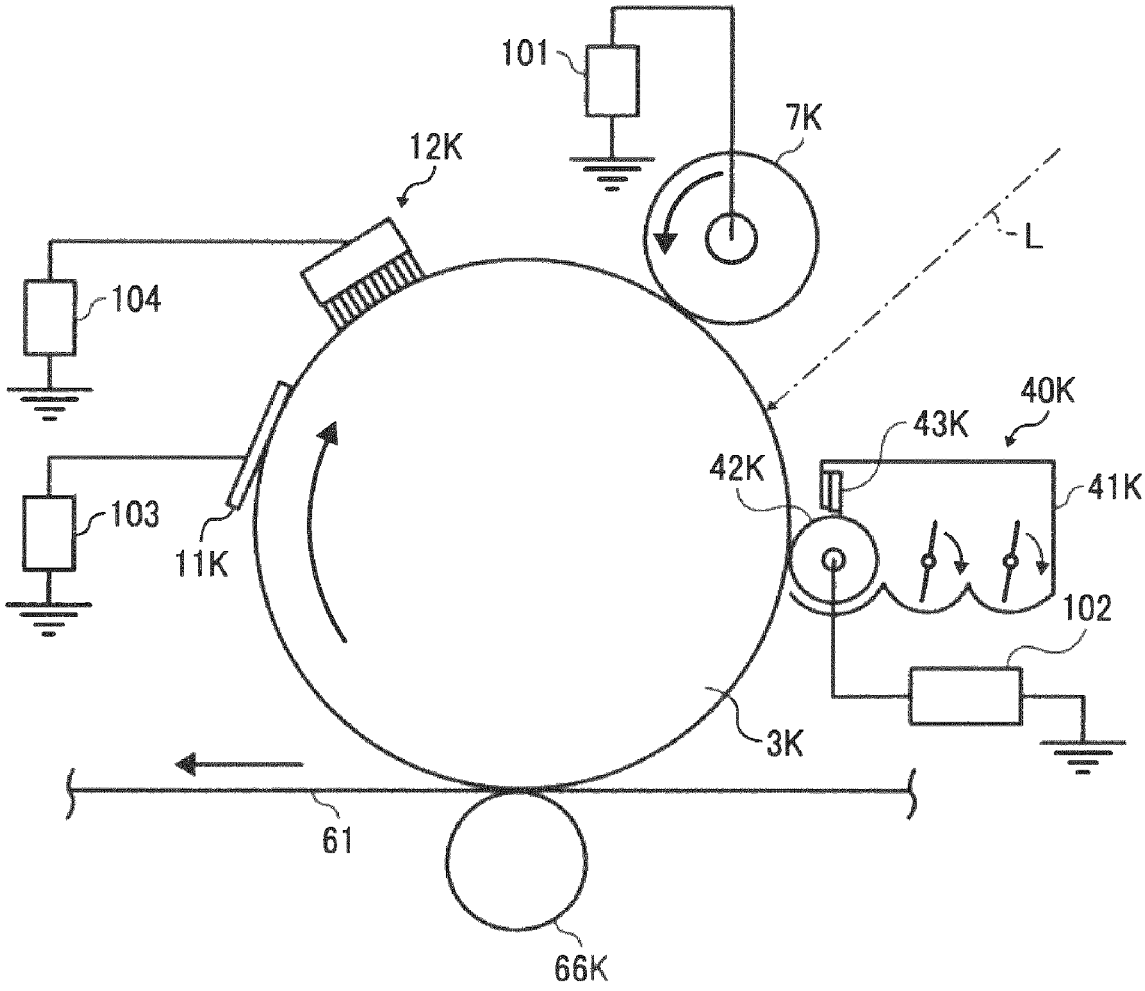
FIG. 2 is a view showing a configuration of a K process unit of the printer.

FIG. 2 is an enlarged configuration diagram showing the K process unit 1K out of the four process units 1Y, M, C and K along with a peripheral configuration thereof. In the drawing, the K process unit 1K holds the photoreceptor 3K, a charging roller 7K, an unshown destaticizing lamp, a conductive sheet 11K, a brush member 12K, a developing device 40K functioning as developing means, and other members in a common unit casing (holding body) as one unit, and makes this unit casing detachable with respect to the printer main body.

The K photoreceptor 3K, which is a body to be charged and a latent image carrier, is a drum with a diameter of approximately 24 [mm] in which a photosensitive layer made of a negatively-charged organic photoconductive material (OPC) is coated on a surface of a conductive substrate made of an aluminum pipe stock, and this drum is rotated and driven by the unshown driving means in the clockwise direction in the drawing at a predetermined linear velocity.

The charging roller 7K is obtained by coating a peripheral surface of a metallic rotation axis member with a conductive roller portion made of conductive rubber or the like, and is brought into contact with the photoreceptor 3K while being rotated and driven around the rotation axis member by the unshown driving means in the counterclockwise direction in the drawing. The metallic rotation axis member of the charging roller 7K is applied with a charging bias by a charging power supply 101. Then, electric discharge occurs between the charging roller 7K and the photoreceptor 3K, whereby the surface of the photoreceptor 3K is uniformly charged to a negative polarity.

The surface of the K photoreceptor 3K that is charged uniformly is subjected to optical scanning by the above-mentioned optical writing unit (50), whereby a K electrostatic latent image (image of a negative polarity that has a potential lower than that of a texture portion) is formed on the surface, and this electrostatic latent image is developed to a K toner image by the K developing device 40K.

The K developing device 40K has a developing roller 42K, a peripheral surface of which is partially exposed from an opening provided in a casing 41K. This developing roller 42K rotates while carrying, on the peripheral surface thereof, unshown K toner stored within the casing 41K. As the developing roller 42K rotates, the K toner that is carried on the surface of the developing roller 42K is transported to a developing region where the developing roller 42K and the photoreceptor 3K face each other or contact with each other.

In this developing region, a developing potential, which electrostatically moves the K toner of a negative polarity from the roller side to the latent image side, acts between the developing roller 42K applied with a developing bias of a negative polarity from a developing power supply 102 and the electrostatic latent image of the photoreceptor 3K. Moreover, a non-developing potential, which electrostatically moves the K toner of a negative polarity from the texture portion side to the roller side, acts between the developing roller 42K and the uniformly charged section (texture portion) of the photoreceptor 3Y. The K toner on the developing roller 42K is released from the top of the roller by the action of the developing potential and thereby is shifted to the electrostatic latent image on the photoreceptor 3K. By this transition of the K toner, the electrostatic latent image on the photoreceptor 3K is developed to the K toner image. This K toner is primarily transferred onto an intermediate transfer belt 61 of an after-mentioned transfer unit as the photoreceptor 3K rotates.

After the K toner passes through a primary transfer nip, the conductive sheet 11K, a non-brush-like member, is in contact with the surface of the photoreceptor 3K before the K toner enters the position of abutment between the photoreceptor 3K and charging roller 7K or the abovementioned developing region. Also, after the K toner passes through the position of abutment between the photoreceptor 3K and conductive sheet 11K, a brush member 12K is in contact with the surface of the photoreceptor 3K before the K toner enters the position of abutment between the photoreceptor 3K and charging roller 7K. The roles of the conductive sheet 11K and brush member 12K are described hereinafter.

It should be noted that in the K process unit 1K the charging means for uniformly charging the surface of the photoreceptor 3K is configured by the charging roller 7K, conductive sheet 11K, brush member 12K and the like. Also, the conductive sheet 11K is applied with a sheet bias by a sheet bias power supply 103. The brush member 12K is applied with a brush bias by a brush power supply 104.

The K process unit 1K was described above, thus explanations of the other process units 1Y, M and C having the same configuration as the K process unit 1K are omitted.

In FIG. 1 illustrated previously, the transfer unit 60 is disposed below the process units 1Y, M, C and K of respective colors. In this transfer unit 60 the endless intermediate transfer belt 61 is tightly stretched by a plurality of stretching rollers and thereby endlessly moved in the counterclockwise direction in the drawing. The plurality of stretching rollers indicate, specifically, driven roller 62, driving roller 63, four primary transfer bias rollers 66Y, M, C and K, and the like.

The driven roller 62, the primary transfer bias rollers 66Y through K, and the driving roller 63 are all in contact with the rear surface (loop inner peripheral surface) of the intermediate transfer belt 61. Each of the four primary transfer bias rollers 66Y, M, C and K is obtained by coating a metallic cored bar with sponge or other elastic body, and is pressed against each of the photoreceptors 3Y, M, C and K of the respective colors Y, M, C and K to interpose the intermediate transfer belt 61 therebetween. Accordingly, the four photoreceptors 3Y, M, C and K contact with the intermediate transfer belt 61 at a predetermined length in a belt moving direction, whereby four primary transfer nips of the respective colors Y, M, C and K are formed.

Each of the cored bars of the four primary transfer bias rollers 66Y, M, C and K is applied with a primary transfer bias that is subjected to constant current control by a transfer bias power supply, which is not shown. Consequently, transfer charges are applied to the rear surface of the intermediate transfer belt 61 via the four primary transfer bias rollers 66Y, M, C and K, whereby a transfer electric field is formed between the intermediate transfer belt 61 and each of the photoreceptors 3Y, M, C and K at each primary transfer nip. Note that although the present printer is provided with the primary transfer bias rollers 66Y, M, C and K as primary transfer means, brush-like members or blade like members may be used in place of the rollers. Moreover, a transfer charger or the like may be used.

The Y, M, C and K toner image formed on the photoreceptors 3Y, M, C and K of the respective colors are stacked on the intermediate transfer belt 61 at the primary transfer nips of the respective colors, and transferred. In this manner, a toner image of the four stacked colors is formed on the intermediate transfer belt 61 (referred to as "four-color toner image" hereinafter).

In a section of the intermediate transfer belt 61 where the driving roller 63 is stretched, a secondary transfer bias roller 67 abuts against each side of the belt, whereby a secondary transfer nip is formed. The secondary transfer bias roller 67 is applied with a secondary transfer bias by voltage applying means configured by an unshown power supply and wires. Accordingly, a secondary transfer electric field is formed between the secondary transfer bias roller 67 and a grounded secondary transfer nip rear side roller 64. The four-color toner image formed on the intermediate transfer belt 61 enters the secondary transfer nip as the belt endlessly moves.

The present printer has a paper feed cassette, not shown, which stores therein a pile of a plurality of stacked recording papers P. The top recording paper P is sent out to a paper feeding passage at a predetermined timing. The sent recording paper P is sandwiched by a resist nip between the resist roller pair 54 disposed at an end of the paper feeding passage.

The resist roller pair 54 rotates and drives both rollers thereof in order to sandwich the recording paper P sent from the paper feed cassette at the resist nip, but stops the rotation and drive of the both rollers once they sandwich the leading end of the recording paper P. Then, the recording paper P is sent toward the secondary transfer nip at a timing at which the recording paper P can be synchronized with the four-color toner image formed on the intermediate transfer belt 61. At the secondary transfer nip, the four-color toner image formed on the intermediate transfer belt 61 is secondarily transferred at once onto the recording paper P by an action of the secondary transfer electric field or nip pressure, and is then combined with the white color of the recording paper P to become a full-color image.

The recording paper P on which the full-color image is formed in this manner is discharged from the secondary transfer nip and thereafter sent to a fixing device, not shown, to fix the full-color image.

Secondary transfer residual toner that adheres to the surface of the intermediate transfer belt 61 after the recording paper passes through the secondary transfer nip is removed from the belt surface by a belt cleaning device 68.

It should be noted that the transfer residual toner adheres to the surfaces of the photoreceptors after the toner passes through the abovementioned primary transfer nip, but the process units 1Y, C, M and K of the respective colors of the present printer are not provided with cleaning means for cleaning the transfer residual toner. Regarding the transfer residual toner, a cleaner-less system for recovering the transfer residual toner into the developing roller of the developing device is employed.

In the present printer having the basic configuration described above, each of the four photoreceptors 3Y, M, C and K functions as a latent image carrier for carrying a latent image on the surface that is endlessly moved by the rotation of the photoreceptor. Also, the optical writing unit 50 functions as latent image forming means for forming a latent image on the uniformly charged photoreceptor surface.

Next, the experiment carried out by the three inventors of the present invention is described.

The inventors of the present invention prepared a testing machine that has the same configuration as the printer according to the embodiments shown in FIG. 1 and FIG. 2. Then, while appropriately changing the conditions of charging biases and the like by using this testing machine, the inventors printed a black-and-white half chart (halftone grayscale image) on five thousand A4 sheets at an image area rate of 5 [%], under each of the conditions. For a predetermined number of prints out of the five thousand prints, a black solid image was output in addition to the half chart. Printing of the five thousand sheets was provided repeatedly with a first period (printing in progress) in which continuous printing is performed, and a second period in which the abovementioned sheet bias and brush bias are switched to values different from those of the first period for a predetermined amount of time, while idling each equipment without performing optical writing and the like on the photoreceptors. Then, based on the result of enlarging and observing the printed image, the presence or absence of defective charging of the photoreceptors was evaluated.

The defective charging was evaluated based on the presence or absence of stripes or solid memory stain. Specifically, if a white stripe or a black stripe was observed in the half chart due to local defective charging caused by transfer residual toner on the photoreceptor 3K, the result was evaluated as X, and if not, the result was evaluated as O. Moreover, if a solid-like thin toner (solid memory stain) was adhered to a texture portion (non-image portion) of a printed sheet, the result was evaluated as x, and if not, the result was evaluated as O. If charging processing is performed in a state in which a large quantity of transfer residual toner adheres to a local section on the photoreceptor 3K, a white stripe or a black stripe that is caused by defective charging in the local section is generated. Also, if the charging roller (7K) uniformly charges the photoreceptor 3K to which a large quantity of transfer residual toner adheres in the form of a solid-like thin layer, the solid adhering part causes defective charging, and toner having low charge quantity or inversely charged toner within the transfer residual toner passes through the developing region directly, whereby a solid memory stain is generated on the printed sheet.

Process linear speed, which is the linear speed of each of the photoreceptors 3Y, M, C and K and the intermediate transfer belt 61 in the continuous printing, was set to 100 [mm/sec].

As the charging roller 7K, the one having an outer diameter of 10 [mm] and obtained by coating the peripheral surface of the rotation axis member having a diameter of 6 [mm] with a roller portion made of conductive rubber was used. Also, as the conductive sheet 11K, the one having a thickness of 0.1 [mm] was used, and this sheet was embedded in the photoreceptor 3K at a biting amount of 0.1 through 1 [mm].

As the brush member 12K, the one in which a surface of a metallic support portion is provided with a brush portion having a plurality of upright conductive bristles was used, and this brush portion was caused to abut against the surface of the photoreceptor 3K. The plurality of bristles were obtained by cutting conductive fibers into a predetermined length. Examples of the material of the bristles include nylon 6™, nylon 12™, acrylic, vinylon, polyester, and other resins. Conductive particles such as carbon or metallic fine particles are dispersed in such resin material to have electrical conductivity.

The K toner was obtained by adjusting the average particle diameter thereof to 8.5 [μm] according to a crushing technique, and a K toner applied with external additives was used.

The results of experiments performed under the abovementioned conditions are shown FIG. 3 hereinafter. It should be noted that in any of the conditions a charging bias of −1100 [V] was applied to the charging roller (7K) and the photoreceptor 3K was uniformly charged to approximately −900 [V]. These potentials are maintained until immediately before the photoreceptor surface enters the primary transfer nip, but the surface of the photoreceptor 3K that has passed through the primary transfer nip is affected by transfer current generated at the primary transfer nip, whereby the potential decreases to approximately −20 [V]. Also, a developing bias applied to the developing roller was −250 [V].

Figure 4:
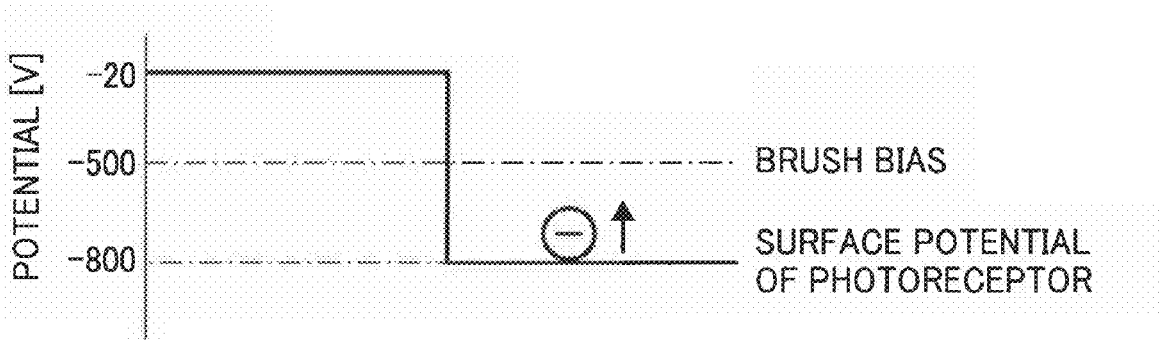
FIG. 4 is a graph showing the potentials of a brush bias and a photoreceptor surface of the process unit obtained in a first period.

In the experiment of Experiment No. 1 in FIG. 3, a sheet bias of −1000 [V] was applied to the conductive sheet (11K) and a brush bias of −500 [V] was applied to the brush member (12K) during the first period in which image creation processing was performed on the photoreceptor 3K. The potential of the surface of the photoreceptor (3K) after the toner passes through the position of abutment with the conductive sheet was −800 [V] when measured by a known surface potential sensor. Since the surface potential was approximately −20 [V] immediately after passing through the primary transfer nip, charging processing using electric discharge was performed also between the conductive sheet and photoreceptor. At this moment, the toner having low charge quantity or inversely charged toner within the transfer residual toner adhering to the surface of the photoreceptor (3K) also was charged sufficiently to the negative side by electric discharge. Between the conductive sheet and photoreceptor, the transfer residual toner passes through between the sheet and the photoreceptor while being kept adhered to the surface of the photoreceptor having a lower negative potential. Thereafter, once the transfer residual toner enters the abutting portion between the brush member (12K) and photoreceptor as the photoreceptor rotates, the transfer residual toner is smoothened by the brush member or, as shown in FIG. 4, shifted to the brush member (potential thereof is −500 V) having a lower negative potential than the photoreceptor (surface potential thereof is −800 V) and then trapped into the brush. In fact, when the testing machine was stopped to check the brush member (12K) during the continuous printing, it was confirmed that an appropriate amount of K toner was trapped in the brush member.

If a large quantity of K toner trapped in the brush member (12K) is accumulated as described above, a large quantity of K toner that is not trapped completely will eventually be shifted to the photoreceptor at irregular times. However, in each experiment, the second period for performing idling operation is provided after the first period for performing the continuous printing, thus as long as the K toner trapped during the first period can be discharged back from the brush member to the photoreceptor during the second period, the image is not affected even if defective charging of the photoreceptor occurs. The reason is that image creation is not performed during the second period.

Figure 5:
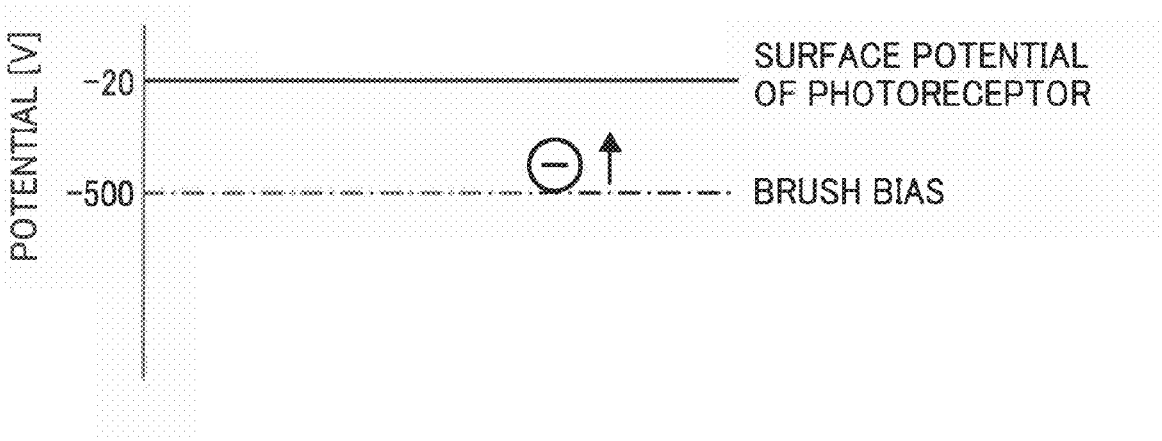
FIG. 5 is a graph showing the potentials of the brush bias and photoreceptor surface of the process unit obtained in a second period.

Therefore, in the second period of the experiment of Experiment No. 1, as shown in FIG. 3, a sheet bias of 0 [V] (GND) is applied to the conductive sheet (11K), while a brush bias of −500 [V] is applied to the brush member, as with the first period. Electric discharge is not performed between the conductive sheet and photoreceptor, thus the surface potential of the photoreceptor after the toner passes through the conductive sheet is the same as the potential obtained immediately after the toner passes through the primary transfer nip (approximately −20 V). Such potential that the surface of the photoreceptor has is lower than that of the brush member (12K) to which a brush bias of −500 [V] is applied. Therefore, in the second period, as shown in FIG. 5, the K toner trapped within the brush member is shifted from the inside of the brush to the photoreceptor. Then, as the photoreceptor rotates, the K toner enters a charging nip obtained by abutment of the charging roller (7K) with the photoreceptor, but since the negative potential of the charging roller is higher than that of the photoreceptor (the surface potential of the roller is approximately −1100 V), the K toner passes through the charging nip while being kept adhered to the photoreceptor. Thereafter, in the developing region the K toner is shifted from the photoreceptor to the developing roller having a lower negative potential than the photoreceptor (approximately −250 V), and recovered into the developing device.

By temporarily trapping and recovering the K toner into the brush member in the manner described above, no slid memory stains or stripes were generated in the experiment of Experiment No. 1, as shown in FIG. 3. Specifically, image quality deterioration that is caused by defective charging of the photoreceptor (3K) was prevented from occurring.

On the other hand, in the experiment of Experiment No. 2, the sheet bias and brush bias to be applied during the second period were set to the values same as those applied during the first period. Under such a condition, since the K toner could not be discharged back from the brush member to the photoreceptor in the second period, a large quantity of K toner was accumulated in the brush member. Therefore, as shown in FIG. 3, although no stripes were generated in the initial printing, stripes were generated when printing the $5000^{th}$ sheet, because the large quantity of K toner that was accumulated in the brush member was shifted from the brush to the photoreceptor 3K locally during the first period.

In the experiment of Experiment No. 3 as well, the sheet bias and brush bias to be applied during the second period were set to the values same as those applied during the first period. In addition, the sheet bias that is lower than that applied in Experiment No. 1 or 2, that is, −300 [V], is applied, and, with such a low bias, electric discharge does not occur between the conductive sheet and photoreceptor (the surface potential of the photoreceptor after the toner passes through the conductive sheet is still approximately −20 V). Therefore, the K toner is caused to pass directly through the position of abutment between the brush member and photoreceptor, the charging nip, and the developing region to generate solid memory stains in a state in which the toner having low charge quantity or inversely charged toner contained in the transfer residual toner is located in a thin solid portion during the first period.

In view of the above results, in the printer according to the embodiment, the following member is used as the bias applying means that is configured by the sheet bias power supply 103 for applying a bias to the conductive sheet, i.e., the non-brush-like member, and the brush power supply 104 for applying a bias to the brush member in each of the process units of the respective colors. Specifically, during the first period in which image creation processing is performed on at least the photoreceptor, the conductive sheet and brush member are applied with a bias having a polarity (negative polarity in this example) same as the uniformly charging polarity of the photoreceptor. At this moment, this period uses a combination of a sheet bias and a brush bias, which sets the surface potential of the photoreceptor obtained immediately after passing through the position of abutment with the conductive sheet, to a first potential value that is larger than the average value of the surface potential of the brush member to the polarity side same as the charging polarity of the toner (negative side in the present example). For example, as shown in Experiment No. 1, a sheet bias of −1000 [V] sets the surface potential of the photoreceptor obtained immediately after passing through the sheet to −800 [V] as the first potential value, which is larger to the negative side than the brush bias of −500 [V] (substantially the same as the surface potential of the brush) On the other hand, the second period in which the image creation processing is not performed after finishing a print job or the like uses a combination of a sheet bias and a brush bias, which sets the surface potential of the photoreceptor obtained immediately after passing through the position of abutment with the conductive sheet, to a second potential value that is larger than the average value of the surface potential of the brush member to a polarity side (negative side in this example) opposite to the charging polarity of the toner. For example, as shown in Experiment No. 1, a sheet bias of 0 [V] sets the surface potential of the photoreceptor obtained after passing through the sheet to −20 [V] as the second potential value, which is larger to the positive side than the brush bias of −500 [V].

The reason that "average value" of the surface potential of the brush member is obtained is that a bias obtained by superimposing AC voltage on DC voltage is employed as the brush bias. In the case of DC voltage, "average value" of the surface potential is the value of the DC voltage itself, but in the case of superimposed voltage the value of not the voltage that changes periodically but the superimposed DC voltage becomes substantially equal to the average value of the surface potential.

Moreover, anon-brush-like member having other shape, such as a conductive blade, may be used in place of the conductive sheet.

As the photoreceptors 3Y, C, M and K, the ones having a surface roughness Ra of at least 0.014 and equal to or lower than 0.066 are used. By setting the surface roughness Ra of each photoreceptor to 0.014 or higher, the contact area between the transfer residual toner and photoreceptor can be reduced to improve the primary transfer efficiency of a toner image. However, if the surface roughness Ra of the photoreceptor is set to be larger than 0.066, toner particles penetrate subtle concave portions on the photoreceptor surface, reducing the efficiency of trapping the toner in the brush member.

Figure 6:
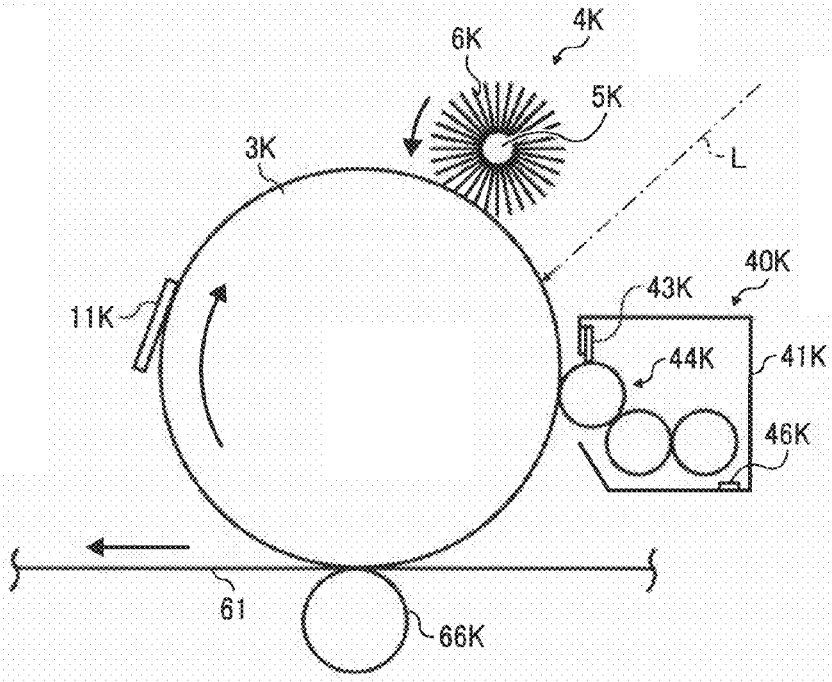
FIG. 6 is a view showing a K process unit of a first modification apparatus of the printer according to the present embodiment, and a peripheral configuration thereof.

FIG. 6 shows the K process unit 1K and its peripheral configuration of a first modification apparatus of the printer according to the present embodiment. In the first modification apparatus, a developing device of a two-component development system using a two-component developer is adopted as the developing device of each of process units of the respective colors.

In this drawing, the K developing device 40K has a developing roll 44K, a peripheral surface of which is partially exposed from the opening provided in the casing 41K. This developing roll 44K has a developing sleeve, which is rotated and driven by unshown driving means and composed of a nonmagnetic pipe, and a magnet roller, not shown, which is internally contained so as not to rotate along with the developing sleeve. The casing 41K contains a K developer, not shown, which has a magnetic carrier and a negatively charged K toner. The K developer, which is stirred and transported by two screw members in a direction perpendicular to the page of the drawing and thereby the K toner thereof is frictionally charged, is absorbed into the surface of the rotating developing sleeve of the developing roll 44K by the magnetic force of the magnet roller within the developing roll 44K, and is drawn up. Then, when the K developer passes through the position facing a developing doctor 43K as the developing sleeve rotates, the layer thickness of the K developer is regulated, and thereafter the K developer is transported to the developing region facing the photoreceptor 3K.

A toner concentration sensor 46K configured by a permeability sensor is fixed to a bottom plate of the casing 41K and outputs voltage of a value corresponding to a permeability of the K developer stored in the casing 41K. The permeability of the developer shows a good correlation with toner concentration of the developer, thus the toner concentration sensor 46K outputs voltage of a value corresponding to K toner concentration. The value of the output voltage is sent to a toner replenishment control portion which is not shown.

The toner replenishment control portion has storage means such as RAM, and stores therein data on K Vtref, which is a target value of the voltage output from the K toner concentration sensor 46K, and data on Y, M and C Vtref, which are target values of voltage output from a T sensor installed in other developing device. In the K developing device 40K, the value of the voltage output from the toner concentration sensor 46K is compared with the K Vtref, and a K toner concentration replenishing device, not shown, is driven for a period of time corresponding to the result of comparison. Accordingly, K toner to be replenished is replenished into the developing device 40K. In this manner, drive of the K toner replenishing device is controlled (toner replenishment control), whereby, as developing is performed, an appropriate amount of K toner is replenished into the K developer in which the K toner concentration is reduced, and the K toner concentration of the K developer contained in the developing device 40K is kept within a predetermined range. It should be noted that the same toner replenishment control is conducted in the developing devices of the other color process units.

In the first modification apparatus, a rotatable charging brush roller 4K is provided in place of the fixed brush member. This charging brush roller 4K has a metallic rotation axis member 5K that is supported rotatably by a bearing, not shown, and a plurality of bristles (conductive fibers) 6K that are provided upright on the surface of the rotation axis member 5K. These bristles 6K form a brush roller portion on the rotation axis member 5K. The charging brush roller 4K is rotated and driven around the rotation axis member 5K in the counterclockwise direction in the drawing by driving means, not shown, and at the same time causes the top ends of the bristles 6K of the brush roller portion to rub the photoreceptor 3K. A charging power supply, not shown, is connected to the metallic rotation axis member 5K.

In the first modification apparatus, the charging brush roller 4K, which is the brush member, is used also as uniformly charging means, thus a charging roller for uniformly charging the photoreceptor is not provided. The rotation axis member 5K of the charging brush roller 4K is applied with a charging bias obtained by superimposing DC voltage of negative polarity on AC voltage, by the charging power supply. Then, electric discharge occurs between the bristles of the charging brush roller 4K and the photoreceptor 3K, whereby the photoreceptor 3K is uniformly charged to a potential that is slightly lower than that of the DC component (superimposed DC voltage) of the charging bias. In the charging brush roller 4K to which the charging bias is applied, the average value of the surface potential of the bristles is substantially equal to the value of the DC component of the charging bias. Therefore, in the first period, for example, when a sheet bias of −800 [V] is applied to the conductive sheet 11K and the surface potential of the photoreceptor 3K obtained after passing through the sheet is set to −600 [V], the transfer residual toner can be trapped into the charging brush roller 4K by adopting, as the charging bias, a bias in which a DC voltage of −700 [V] is applied to the AC voltage. Then, by setting the sheet bias to 0 [V] in the second period, the transfer residual toner trapped in the charging brush roller 4K can be discharged back to the photoreceptor 3K.

It should be noted that the first period adopts a combination of a sheet bias and a brush bias, which sets the surface potential of the photoreceptor obtained immediately after passing through the sheet, to the first potential value that is larger than the maximum value of the surface potential of the charging brush roller on the polarity side same as the toner charging polarity, the surface potential of the charging brush roller being changed over time by the AC voltage of the charging bias. Also, the second period adopts a combination of a sheet bias and a charging bias, which sets the surface potential of the photoreceptor obtained immediately after passing through the sheet, to the second potential value that is larger to the polarity side than the maximum value of the surface potential of the charging brush roller on the polarity side opposite to the toner charging polarity. According to such a configuration, in the first period the surface potential of the charging brush roller can be set to be lower than the surface potential of the photoreceptor regardless of potential oscillation caused by the AC component of the charging bias, whereby the transfer residual toner can be securely trapped into the charging brush roller. Moreover, in the second period the surface potential of the charging brush roller is set to be higher than the surface potential of the photoreceptor, whereby the transfer residual toner can be securely discharged back from the charging brush roller to the photoreceptor.

Figure 7:
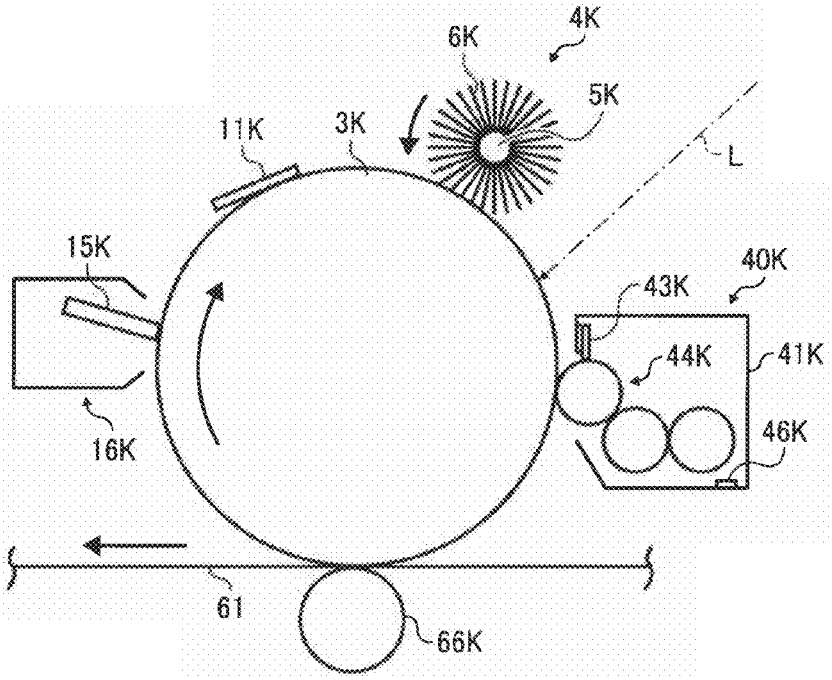
FIG. 7 is a view showing a K process unit of a second modification apparatus of the printer according to the present embodiment, and a peripheral configuration thereof.

FIG. 7 shows the K process unit 1K and its peripheral configuration of a second modification apparatus of the printer according to the present embodiment. The second modification apparatus is different from the first modification apparatus in that there is provided a photoreceptor cleaning device 16K that uses a cleaning blade 15K to scrape off the transfer residual toner on the photoreceptor 3K. The surface of the photoreceptor 3K that has passed through the primary transfer nip is subjected to cleaning processing by the photoreceptor cleaning device 16K and thereafter enters the position of abutment with the conductive sheet 11K. The rest of the configuration is the same as that of the first modification apparatus.

Figures 8, 9:
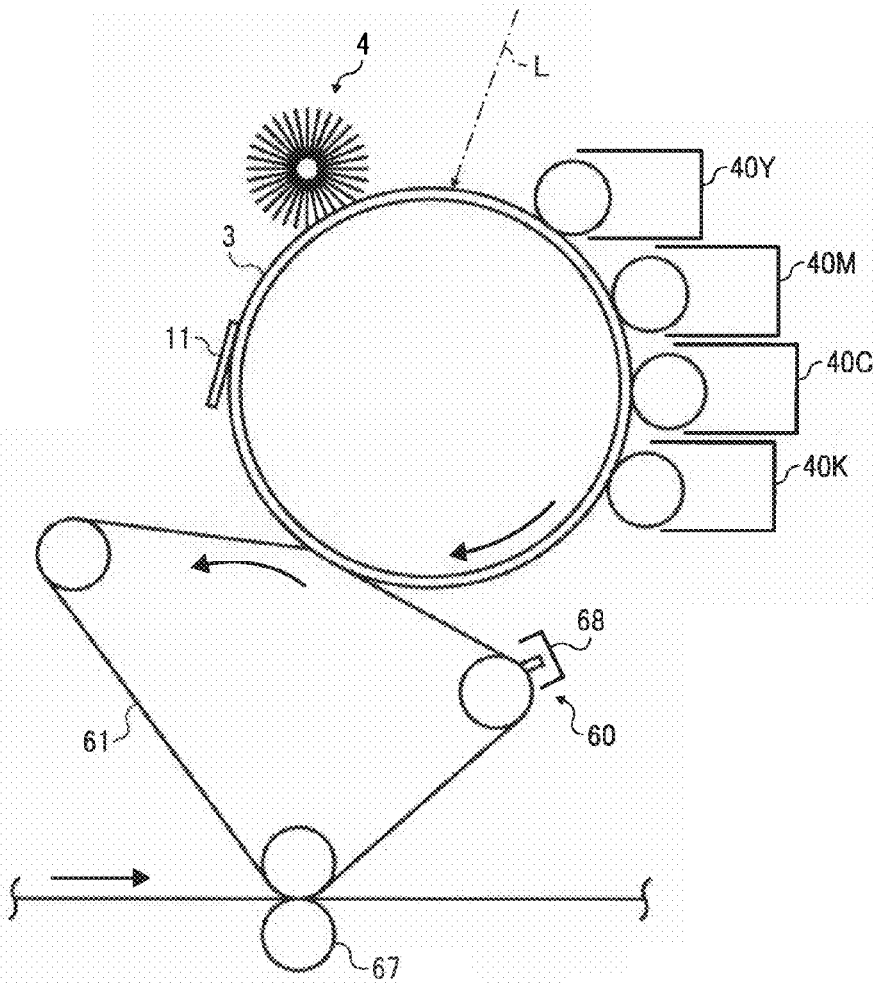
FIG. 8 is a schematic configuration diagram showing a third modification apparatus of the printer according to the present embodiment.
FIG. 9 is a table showing the result of the experiment according to the present embodiment.

FIG. 8 shows a third modification apparatus of the printer according to the present embodiment. In this third modification apparatus a single system is adopted in place of a tandem system. The four developing devices 40Y, M, C and K for the respective colors Y, M, C and K are disposed around a drum-like photoreceptor 3. First, a Y electrostatic latent image is formed on the surface of the photoreceptor 3 by performing optical scanning using a laser beam L. This electrostatic latent image is developed to Y toner image by the Y developing device 40Y and then primarily transferred to the intermediate transfer belt 61. The belt surface that has passed through the primary transfer nip passes through the abutting position between the conductive sheet 11 and photoreceptor 3 and is then uniformly charged by the charging brush roller 4. At this moment, the toner having low charge quantity or inversely charged toner within the transfer residual toner on the photoreceptor 3 is charged sufficiently to the negative polarity side by the conductive sheet 11 and then trapped into the charging brush roller 4.

The surface of the photoreceptor 3 that has been subjected to uniform charging processing carries an M electrostatic latent image that is formed by optical scanning using the laser beam L. This electrostatic latent image is developed to an M toner image by the M developing device 40M, superimposed on the Y toner image formed on the intermediate transfer belt 61, and primarily transferred. Hereinafter, the same process is performed in which C and K toner images that are sequentially formed on the surface of the photoreceptor 3 are superimposed sequentially on the two Y and M toner images formed on the intermediate transfer belt 61, and then are primarily transferred.

Next is described a printer of each embodiment in which more characteristic configuration is added to the printer of the present embodiment. It should be noted that the configuration of the printer of each embodiment is the same as that of the present embodiment unless otherwise stated.

First Embodiment

In the printer according to the first embodiment, the following member is used as the bias applying means configured by the sheet bias power supply (103), brush power supply (104) and the like. Specifically, in the first period the optical writing unit (50), which is the latent image forming means, starts latent image formation processing, and thereafter the combination of biases used in the second period is switched to the combination of biases used in the first period. More specifically, a time lag between the start of the latent image formation processing performed by the optical writing unit and the start of switching between the bias combinations is made shorter than the time required for the photoreceptor surface to enter the position of abutment with the conductive sheet after entering a position where optical writing is performed by the optical writing unit (latent image formation step). According to such a configuration, the bias combination used in the second period is switched to the bias combination used in the first period before a photoreceptor region carrying a leading end of the toner image, i.e., a photoreceptor region to which the transfer residual toner adheres, passes through the primary transfer nip, whereby trapping of the transfer residual toner into the brush can be prevented from failing due to a delay in switching time. Moreover, the bias combination used in the second period is adopted until immediately before the photoreceptor region to which the transfer residual toner adheres enters the position of abutment with the conductive sheet, whereby the transfer residual toner can be discharged back from the charging brush roller to the photoreceptor efficiently.

Second Embodiment

In the printer according to the second embodiment, the following member is used as the sheet bias power supply which is the bias applying means. Specifically, there is used a member that applies a sheet bias composed only of DC voltage to the conductive sheet which is a non-brush-like member. The reason that such sheet bias power supply is used is as follows. Specifically, if the sheet bias having AC component is used, compared to the one composed only of DC voltage, the number of electric discharges from the sheet to the photoreceptor increases, and an electric field that attracts the toner from the photoreceptor toward the sheet side as the AC component oscillates is formed, whereby the transfer residual sheet can be easily caused to adhere to the sheet.

Third Embodiment

In the printer according to the third embodiment, the following member is used as the bias applying means configured by the sheet bias power supply, brush power supply, and the like. Specifically, there is used a member that applies, to the conductive sheet and brush member, a combination of biases that sets the surface potential of the photoreceptor obtained after passing through the sheet to the second potential value having a polarity opposite to the polarity of the average value of the surface potential of the brush member, in the second period. Accordingly, in the second period the transfer residual toner that is trapped into the brush member is strongly attracted toward the photoreceptor having a polarity opposite to that of the toner, whereby the transfer residual toner can be discharged back from the inside of the brush member properly.

It should be noted that the absolute value of the sheet bias in the second period is set to be equal to or lower than 500 [V]. The reason is as follows. Specifically, the inventors of the present invention carried out the experiment of outputting a half chart using the testing machine by adopting, as the bias combination of the first period, the bias combination same as that of Experiment No. 1 shown in FIG. 3 and, at the same time, changing the sheet bias of the second period in various ways. Then, the inventors checked the presence/absence of scumming and defective charging of the photoreceptor on the basis of the printed image. For the scumming, if the toner adheres to the texture portion (non-image portion) of the printed image in the form of dust, the result was evaluated as X, and if not, the result was evaluated as O. As a result, it was confirmed that if the absolute value of the sheet bias composed only of DC voltage is set to a value larger than 500 [V], scumming occurs, as shown in FIG. 9. For this reason, the absolute value is set to be equal to or lower than 500 [V].

Fourth Embodiment

In the printer according to the fourth embodiment, the following member is used as the conductive sheet of each of the process units (1Y, M, C and K) of the respective colors. Specifically, such a member is provided with a first section abutting against the surface of the photoreceptor, and a second section that is dented more than the first section on a downstream side from the first section in a photoreceptor surface movement direction and thereby abuts against the surface of the photoreceptor with a force weaker than that of the first section or faces the surface of the photoreceptor in an on-contact manner.

The reason that such a configuration is used is as follows. Specifically, in the conductive sheet, electric discharge occurs most frequently at a position shifted slightly toward an upstream side of the photoreceptor surface movement direction from an entrance of the position of abutment between the conductive sheet and photoreceptor (uppermost stream section in the photoreceptor surface movement direction). At this position the transfer residual toner that is regulated at the entrance of the abutting portion is accumulated in large quantity, and this transfer residual toner is first caused to fixedly adhere to a side face of the conductive sheet by heat generated by the electric discharge. As this adhering toner grows, it is gradually drawn into the abutting portion from the entrance of the abutting portion by surface movement force of the photoreceptor. Consequently, this adhering toner is interposed between the conductive sheet and photoreceptor in the abutting portion, whereby a comparatively large gap is formed between the conductive sheet and photoreceptor at a position on a downstream side from the adhering toner in the photoreceptor surface movement direction. Then, comparatively a large amount of electricity is discharged at this gap, and the transfer residual toner that has passed under the adhering toner is caused to fixedly adhere to a section on the downstream side from the adhering toner of the conductive sheet in the photoreceptor surface movement direction, by heat generated by the discharged electricity. In the conductive sheet the adhering toner gradually grows toward the downstream side of the photoreceptor surface movement direction in the abutting portion as described above, and easily covers the entire area. Then, electric discharge is no longer performed properly in the entire area of the abutting portion, causing defective charging of the inversely charged toner or toner with low charge quantity of the transfer residual toner.

In the present printer, the adhering toner gradually grows in the first section of the conductive sheet in the same manner. However, the second section of the conductive sheet abuts against the photoreceptor with a force weaker than that of the first section, or faces the photoreceptor in a non-contact manner, thus the adhesiveness of the transfer residual toner against the second section is not sufficient. Therefore, toner adhesion with respect to the second section is limited (in the case of a contact state) or avoided (in the case of a non-contact state), compared to the first section. Accordingly, electric discharge is caused properly between the second section and photoreceptor over a long period of time to sufficiently charge the inversely charged toner or toner with low charge quantity within the transfer residual toner. As a result, image quality deterioration that is caused by the inversely charged toner or toner with low charge quantity can be prevented from occurring over a long period of time.

Fifth Embodiment

In the printer according to the fifth embodiment, the following member is used as the conductive sheet of each of the process units (1Y, M, C and K) of the respective colors. Specifically, in this member, an abutting region of the surface that abuts against the photoreceptor is provided with a groove that extends from an upstream end of the abutting region in the photoreceptor surface movement direction to an end portion of the abutting region that is different from the upstream end. According to such a configuration, the groove that is provided in the region of the conductive sheet abutting against the photoreceptor opens one end side in the direction of extension of the groove toward an upstream side of the photoreceptor surf ace movement direction, while forming a gap between the conductive sheet and the photoreceptor. The toner that is blocked on the upstream side of the photoreceptor surface movement direction from the abutting region is received by the groove from the opening thereof, and then escapes from the other end of the groove while being moved in the direction of extension of the groove by the surface movement of the photoreceptor. By such movement of the toner within the groove, the transfer residual toner blocked by the conductive sheet is caused to leave the abutting area promptly, whereby the amount of toner accumulated on the upstream side can be reduced to be lower than that of the abutting area. Accordingly, by limiting the adhesion of the toner against the conductive sheet, image quality deterioration that is caused by the inversely charged toner or toner with low charge quantity within the transfer residual toner can be prevented from occurring over a long period of time.

Sixth Embodiment

In the printer according to the sixth embodiment, the charging brush roller is used as the brush member of each of the process units (1Y, M, C and K) of the respective colors, as with the first modification apparatus described above, and this charging brush roller is also used as the uniformly charging means. In the second period, as the driving means for rotating and driving the charging brush roller serving as a rotating brush roller, there is used a member that changes the rotation speed of the charging brush roller so as to constantly change an inclination state of the bristles of the brush roller portion abutting against the photoreceptor. According to such a configuration, the inclination state of the bristles of the brush roller portion is changed over time, whereby the position of abutment between the bristles and photoreceptor is changed and the bristles are caused to oscillate slightly so that the transfer residual toner can be discharged from the charging brush roller.

Seventh Embodiment

The process unit of each color provided in the printer according to the seventh embodiment has biasing means for biasing the brush member toward the photoreceptor so as to make the amount of bias of the brush member against the photoreceptor in the first period smaller than the amount of bias of the brush member against the photoreceptor in the second period. According to such a configuration, a failure of trapping the toner into the brush member that is caused by using excessive pressure to cause the brush member to abut against the photoreceptor can be avoided, and charge injection from the brush to the toner can also be avoided, in the first period. Moreover, in the second period, by increasing the pressure for causing the brush member to abut against the photoreceptor, the effect of scraping off the toner from the brush can be improved, and toner discharge efficiency can also be improved.

As described above, in the printer according to the present embodiment, in the first period for creating images, the bias applying means that is configured by the sheet bias power supply 103, brush power supply 104 and the like applies, to the conductive sheet and brush member, the bias combination that sets the surface potential of the photoreceptor obtained immediately after passing through the position of abutment with the conductive sheet functioning as the non-brush-like member, to the first potential value that is larger than the average value of the surface potential of the brush member to the polarity side same as the toner charging polarity. On the other hand, in the second period in which images are not created, the bias applying means applies, to the conductive sheet and brush member, the bias combination that sets the surface potential of the photoreceptor obtained immediately after passing through the position of abutment with the conductive sheet, to the second potential value that is larger than the average value of the surface potential of the brush member to the polarity side opposite to the toner charging polarity. According to such a configuration, in the first period, charge injection or electric discharge from the sheet is used to apply a charge having a normal charging polarity to the toner having low charge quantity or inversely charged toner of the transfer residual toner welded on the flat surface of the conductive sheet, whereby the charge amount of the transfer residual toner is made uniform, and thereafter this transfer residual toner can be trapped into the brush member. Moreover, in the second period, the transfer residual toner trapped in the brush member is discharged to the photoreceptor, whereby the transfer residual toner can be prevented from accumulating excessively in the brush member, and the discharged transfer residual toner can be recovered into the developing device.

In addition, in the printer according to the present embodiment, as the uniformly charging means, there is used the member that uniformly charges the surface of the photoreceptor serving as a latent image carrier, while abutting against the photoreceptor surface, by means of the charging roller functioning as the charging member to which a predetermined charging bias is applied. Moreover, the conductive sheet is used as a non-brush-like member. According to such a configuration, the photoreceptor is uniformly charged by the charging member using a contact system, whereby generation of ozone can be reduced, compared to when a scorotron or other charger system is used. In addition, a commercially available general conductive sheet can be used as the non-brush-like member to achieve cost reduction. It should be noted that a conductive blade can be also used as the non-brush-like member to achieve cost reduction for the same reason.

Moreover, in the printer according to the first embodiment described above, as the bias applying means configured by the sheet bias power supply 103, brush power supply 104 and the like, there is used a member that switches the bias combination for setting the surface potential of the photoreceptor to the second potential value to the bias combination for setting the surface potential of the photoreceptor to the first potential value after the latent image formation processing is started by the optical writing unit 50 functioning as the latent image forming means. According to such a configuration, the time period for discharging the transfer residual toner from the brush member to the photoreceptor can be increased, compared to the case where the bias combinations are switched before the latent image formation processing is started.

In the printer according to the first embodiment described above, as the bias applying means, there is used a member in which a time lag between the start of the latent image formation processing and the start of switching between the bias combinations is made shorter than the time required for the photoreceptor surface to enter the position of abutment with the conductive sheet after entering a position where optical writing is performed by the optical writing unit 50 (latent image formation step). According to such a configuration, the bias combination used in the second period is switched to the bias combination used in the first period before a photoreceptor region to which the transfer residual toner adheres passes through the primary transfer nip, whereby trapping of the transfer residual toner into the brush can be prevented from failing due to a delay in switching time. Moreover, the bias combination used in the second period is adopted until immediately before the photoreceptor region to which the transfer residual toner adheres enters the position of abutment with the conductive sheet, whereby the transfer residual toner can be discharged back from the charging brush roller to the photoreceptor efficiently.

Furthermore, in the printer according to the second embodiment described above, as the bias applying means, a member for applying a sheet bias composed only of DC voltage to the conductive sheet is used. According to such a configuration, toner adhesion with respect to the conductive sheet can be limited, compared to when a sheet bias having the AC component is applied.

In the printer according to the third embodiment described above, as the bias applying means, there is used a member for applying, to the conductive sheet and brush member, with a combination of biases that sets the second potential value of the surface of the photoreceptor to a polarity opposite to the polarity of the average value of the surface potential of the brush member, in the second period in which images are not created. According to such a configuration, in the second period the transfer residual toner that is trapped into the brush member is strongly attracted toward the photoreceptor having a polarity opposite to that of the toner, whereby the transfer residual toner can be discharged back from the inside of the brush member properly.

Moreover, in the printer according to the third embodiment described above, as the bias applying means, there is used a member that applies, to the conductive sheet, a sheet bias that has a polarity opposite to that of the toner and has an absolute value of equal to or lower than 500 [V], in the second period. According to such a configuration, the occurrence of scumming can be prevented for the reason described above.

In the printer according to the fourth embodiment described above, as the conductive sheet, there is used a member that is provided with a first section abutting against the surface of the photoreceptor, and a second section that is dented more than the first section on a downstream side from the first section in a photoreceptor surface movement direction and thereby abuts against the surface of the photoreceptor with a force weaker than that of the first section or faces the surface of the photoreceptor in a non-contact manner. According to such a configuration, electric discharge is caused properly between the second section and photoreceptor over a long period of time to sufficiently charge the inversely charged toner or toner with low charge quantity within the transfer residual toner, whereby image quality deterioration that is caused by the inversely charged toner or toner with low charge quantity can be prevented from occurring over a long period of time.

In the printer according to the fifth embodiment described above, as the conductive sheet, there is used a member that is provided, at an abutting region of the surface abutting against the photoreceptor, with a groove that extends from an upstream end of the abutting region in the photoreceptor surface movement direction to an end portion of the abutting region that is different from the upstream end. According to such a configuration, by limiting the adhesion of the toner against the conductive sheet for the reason described above, image quality deterioration that is caused by the inversely charged toner or toner with low charge quantity within the transfer residual toner can be prevented from occurring over a long period of time.

Moreover, in the printer according to the sixth embodiment, as the brush member, there is used a charging roller, i.e., a rotating brush roller, which has the rotation axis member and the brush roller portion configured by a plurality of bristles provided upright on the peripheral surface of the rotation axis member. Also, as the rotating means for rotating and driving the charging brush roller, there is used a member that changes, in the second period, the rotation speed of the charging brush roller so as to constantly change an inclination state of the bristles of the brush roller portion abutting against the photoreceptor. According to such a configuration, the position of abutment between the bristles and photoreceptor is changed and the bristles are caused to oscillate slightly so that the transfer residual toner can be discharged from the charging brush roller.

In the printer according to the present embodiment, as the photoreceptors 3Y, M, C and K, the ones having a surface roughness Ra of at least 0.014 and equal to or lower than 0.066 are used. Therefore, for the reason described above, the contact area between the transfer residual toner and photoreceptor can be reduced to improve the primary transfer efficiency of a toner image, and reduction of the efficiency of trapping the toner in the brush member that is caused by the toner particles penetrating subtle concave portions on the photoreceptor surface can be avoided.

Furthermore, in the first modification apparatus described above, the charging brush roller functioning as the brush member is also used as the charging member, thus it is possible to avoid increase in the cost caused by providing a special charging member for uniformly charging the photoreceptor.

In the first modification apparatus, as the bias applying means, the one that applies a charging bias having AC voltage to the charging brush roller is used, thus destaticization and charging of the photoreceptor can be repeated in a short period of time by means of oscillation of the AC component, to suppress charging irregularity of the photoreceptor.

Moreover, in the first modification apparatus, as the bias applying means, there is used the one that applies, to the conductive sheet and charging brush roller, a bias combination that sets the first potential value to be larger than the maximum value of the surface potential of the charging brush roller on the polarity side same as the polarity of the toner, the surface potential of the charging brush roller being changed over time by the AC voltage of the charging bias, and also sets the second potential value to be larger than the maximum value of the surface potential of the charging brush roller on the polarity side opposite to the polarity of the toner, toward the opposite polarity side. According to such a configuration, in the first period the surface potential of the charging brush roller can be set to be lower than the surface potential of the photoreceptor regardless of potential oscillation caused by the AC component of the charging bias, whereby the transfer residual toner can be securely trapped into the charging brush roller. Moreover, in the second period the surface potential of the charging brush roller is set to be higher than the surface potential of the photoreceptor, whereby the transfer residual toner can be securely discharged back from the charging brush roller to the photoreceptor.

In the printer according to the seventh embodiment described above, there is provided the biasing means for biasing the brush member toward the photoreceptor so as to make the amount of bias of the brush member against the photoreceptor in the first period smaller than the amount of bias of the brush member against the photoreceptor in the second period. According to such a configuration, a failure of trapping the toner into the brush member that is caused by using excessive pressure to cause the brush member to abut against the photoreceptor can be avoided, and charge injection from the brush to the toner can also be avoided, in the first period. Moreover, in the second period, by increasing the pressure for causing the brush member to abut against the photoreceptor, the effect of scraping off the toner from the brush can be improved, and toner discharge efficiency can also be improved.

According to the present invention described above, in place of the brush member, a non-brush-like member is used as the member that abuts against the latent image carrier in a state in which a bias is applied, and at the same time receives, at the abutting portion between the member and the latent image carrier, the transfer residual toner adhering to the surface of the latent image carrier immediately after the transfer step performed by the transfer means. Unlike the brush member, this non-brush-like member cannot trap the transfer residual toner therein, but since a bias having a polarity same as the uniformly charging polarity of the latent image carrier is applied to this non-brush-like member during the predetermined first period, the non-brush-like member can control the charge state of the transfer residual toner. Specifically, when a member having normal charging polarity same as the uniformly charging polarity of the latent image carrier is used as the toner to perform reversal development, the toner having low charge quantity or inversely charged toner within the transfer residual toner can be sufficiently charged to the normal charging polarity by means of charge injection or electric discharge of the non-brush-like member to which the above-mentioned bias is applied. The sufficiently charged transfer residual toner enters the abutting portion between the brush member and latent image carrier as the surface of the latent image carrier moves. Then, the transfer residual toner is made uniform on the surface of the latent image carrier by the brush member or trapped into the brush member. In the present invention, although the bias having the polarity same as the uniformly charging polarity of the latent image carrier is applied to the brush member as well in the first period, the transfer residual toner can be trapped into the brush member charged sufficiently to the normal charging polarity side by making this bias be lower than that of the surface potential of the latent image carrier. Then, in the predetermined second period, the bias to be applied to the brush member is changed to a value higher than that of the surface potential of the latent image carrier, whereby the transfer residual toner can be shifted properly to the latent image carrier without inverting the polarity of the transfer residual toner trapped in the brush member. According to such a configuration, during image creation or during the first period in which defective charging of the latent image carrier impinges on the image quality, the transfer residual toner is securely trapped into the brush member to suppress the occurrence of defective charging of the latent image carrier, while after the completion of development or during the second period in which defective charging of the latent image carrier does not affect the image quality, the transfer residual toner can be shifted from the brush member to the latent image carrier. Therefore, image quality deterioration that is caused by defective charging of the latent image carrier can be prevented more efficiently than the conventional image forming apparatus.

Various modifications will become possible for those skilled in the art after receiving the teachings of the present disclosure, without departing from the scope thereof.

What is claimed is:

1. An image forming apparatus, comprising:

a latent image carrier;

latent image forming means for forming a latent image on a uniformly charged surface;

developing means for developing the latent image formed on the uniformly charged surface and for obtaining a toner image;

transfer means for transferring the toner image formed on the uniformly charged surface to a transfer body; and charging means for uniformly charging a cylindrical rotating surface of the latent image carrier, the charging means includes:

first charging means for charging the cylindrical rotating surface of the latent image carrier, the first charging means being supplied by a first power supply means, and the first charging means being in contact with a portion of the cylindrical rotating surface of the latent image carrier after the portion of the cylindrical rotating surface passes through the transfer means, and before the portion of the cylindrical rotating surface comes in contact with a second charging means;

the second charging means for charging the cylindrical rotating surface of the latent image carrier, the second charging means being supplied by a second power supply means, and the second charging means being in contact with the portion of the cylindrical rotating surface after the portion of the cylindrical rotating surface passes through the first charging means, and before the portion of the cylindrical rotating surface comes in contact with a charging roller means, wherein during a first period, the first power supply means applies a first bias to the first charging means, when the first bias is applied, the first charging means charges a surface potential of the latent image carrier to a first value that has greater potential than a second bias applied by the second power supply means to the second charging means, the first value further having a same polarity as a charging polarity of a toner; and during a second period, the first power supply means applies a third bias to the first charging means, when the third bias is applied, the first charging means charges the surface potential of the latent image carrier to a second value that has a smaller potential than the second bias applied by the second power supply means to the second charging means, the second value also having the same polarity as the charging polarity of the toner.

2. The image forming apparatus as claimed in claim 1, wherein during the second period, the first power supply means applies a fourth bias to the first charging means, when the fourth bias is applied, the first charging means charges the surface potential of the latent image carrier to a third value that has a larger potential than the second bias applied by the second power supply means to the second charging means, the third value having a polarity opposite to the charging polarity of the toner.

3. The image forming apparatus as claimed in claim 2, wherein the first and second charging means uniformly charge the surface of the latent image carrier by means of charging members, the charging member of the first charging means being a conductive sheet or a conductive blade.

4. The image forming apparatus as claimed in claim 3, wherein the charging member of the second charging means is a brush member.

5. The image forming apparatus as claimed in claim 1, wherein the second bias applied by the second power supply means to the second charging means has at least AC voltage.

6. The image forming apparatus as claimed in claim 5, wherein when the first bias applied by the first power supply means causes the first charging means to charge the surface potential of the latent image carrier to a value greater than the maximum absolute value of the bias applied by the second power supply means to the second charging means, and with the same polarity, the bias of the second charging means oscillates over time by the AC voltage.

7. The image forming apparatus as claimed in claim 2, wherein the first and second power supply means switches the biases supplied to the first and second charging means, respectively, in accordance to the first and second periods, after latent image formation processing is started by the latent image forming means.

8. The image forming apparatus as claimed in claim 7, wherein a time lag between the start of the latent image formation processing and a start of a switching between the biases supplied to the first and second charging means in accordance to the first and second periods is made shorter than a time required for the surface of the latent image carrier to move to a position where the surface of the latent image carrier comes in contact with the first charging means, after entering a latent image formation step performed by the latent image forming means.

9. The image forming apparatus as claimed in claim 2, wherein the first, third and fourth biases applied by the first power supply means to the first charging means are composed only of DC voltage.

10. The image forming apparatus as claimed in claim 2, wherein when the first power supply means applies a fifth bias, the first charging means charges the surface potential of the latent image carrier to have a polarity opposite to the polarity of the bias applied by the second charging means during the second period.

11. The image forming apparatus as claimed in claim 10, wherein the second charging means has a bias with a polarity opposite to that of the toner and an absolute value of 500 [V] or lower during the second period.

12. The image forming apparatus as claimed in claim 2, wherein the second power supply means applies the second bias to the second charging means during a first period and applies a sixth bias to the second charging means during a second period such that the bias of the second charging means in the first period is smaller than the bias of the second charging means in the second period.

13. The image forming apparatus as claimed in claim 1, wherein the second charging means is a rotating brush roller including a rotation axis member and a brush roller portion, the brush roller portion being formed by a plurality of bristles formed in an upright direction on a peripheral surface of the rotation axis member, the rotating brush roller further includes a driving means for rotating and driving the brush roller portion and for changing the rotation speed of the rotating brush roller so as to change an inclination state of the plurality of bristles of the brush roller portion in contact with the latent image carrier.

14. The image forming apparatus as claimed in claim 1, wherein the latent image carrier has a surface roughness $R_a$, where 0.014 microinches$\leqq R_a \leqq$0.066 microinches.

15. An image forming apparatus, comprising:

a latent image carrier;

a latent image forming device configured to form a latent image on a uniformly charged surface;

a developing device configured to develop the latent image formed on the uniformly charged surface and to obtain a toner image;

a transfer device configured to transfer the toner image formed on the uniformly charged surface to a transfer body; and a charging device configured to uniformly charge a cylindrical rotating surface of the latent image carrier, the charging device includes:

a first charging unit configured to charge the cylindrical rotating surface, the first charging unit being supplied by a first power supply unit, and the first charging unit being in contact with a portion of the cylindrical rotating surface after the portion of the cylindrical rotating surface passes through the transfer device, and before the portion of the cylindrical rotating surface comes in contact with a second charging unit;

the second charging unit configured to charge the cylindrical rotating surface, the second charging unit being supplied by a second power supply unit, the second charging unit being in contact with the cylindrical rotating surface after the portion of the cylindrical rotating surface passes through the first charging unit, and before the portion of the cylindrical rotating surface comes in contact with a charging roller, wherein during a first period, the first power supply unit applies a first bias to the first charging unit, when the first bias is applied, the first charging unit charges a surface potential of the latent image carrier to a first value that has greater potential than a second bias applied by the second power supply unit to the second charging unit, the first value further having a same polarity as a charging polarity of a toner; and during a second period, the first power supply unit applies a third bias to the first charging unit, when the third bias is applied, the first charging unit charges a surface potential of the latent image carrier to a second value that has a smaller potential than the second bias applied by the second power supply unit to the second charging unit, the second value also having the same polarity as the charging polarity of the toner.

16. The image forming apparatus as claimed in claim 4, wherein during the first period when the first value of the surface potential of the latent image carrier has a greater potential than the second bias applied by the second power supply means to the second charging means, toner is smoothed by the brush member and shifted to the brush member.

17. The image forming apparatus as claimed in claim 4, wherein during the second period when the second value of the surface potential of the latent image carrier has a smaller potential than the second bias applied by the second power supply means to the second charging means, toner is discharged from the brush member onto the latent image carrier.

18. The image forming apparatus as claimed in claim 15, wherein the first and second charging unit uniformly charge the surface of the latent image carrier with charging members, the charging member of the first charging unit being a conductive sheet or a conductive blade, and the charging member of the second charging unit being a brush member.

* * * * *